US006198901B1

(12) United States Patent
Watanabe

(10) Patent No.: US 6,198,901 B1
(45) Date of Patent: Mar. 6, 2001

(54) IMAGE HEATING APPARATUS

(75) Inventor: Osamu Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/339,372

(22) Filed: Jun. 24, 1999

(30) Foreign Application Priority Data

Jun. 25, 1998 (JP) ..... 10-195005

(51) Int. Cl.[7] ..... G03G 15/20
(52) U.S. Cl. ..... 399/328; 399/330
(58) Field of Search ..... 399/330, 335, 399/320, 328; 219/619, 670, 671, 672

(56) References Cited

U.S. PATENT DOCUMENTS 5,471,027 * 11/1995 Call et al. ..... 219/85.13
5,475,194 12/1995 Watanabe et al. ..... 219/216
5,541,636 * 7/1996 Ingram ..... 347/212
5,819,150 * 10/1998 Hayasaki et al. ..... 399/330
5,945,217 * 8/1999 Hanrahan ..... 428/389

FOREIGN PATENT DOCUMENTS 54-039645 3/1979 (JP) .
59-33787 2/1984 (JP) .

* cited by examiner

*Primary Examiner*—William J. Royer
(74) *Attorney, Agent, or Firm*—Fitzpatrick, Cella, Harper & Scinto

(57) ABSTRACT

An image heating apparatus includes an electro-conductive member; an excitation coil for generating magnetic flux; wherein eddy current is produced in the electro-conductive member by the magnetic flux, so that the electro-conductive member generates heat which heats an image on a recording material; a magnetic member for guiding the magnetic flux generated by the excitation coil; a heat removing member for removing heat from the magnetic member and a thermo-conductive member disposed in a gap between the magnetic member and the heat removing member.

9 Claims, 4 Drawing Sheets

WITH THERMOCONDUCTIV ADHESSIVE
(a) FIXING ROLLER
MAGNETIC CORE
WITHOUT THERMOCONDUCTIV ADHESSIVE
(b) FIXING ROLLER
MAGNETIC CORE

IMAGE HEATING APPARATUS

FIELD OF THE INVENTION AND RELATED ART

The present invention relates to a heating apparatus for heating a sheet of recording medium or the like. In particular, it relates to a heating apparatus which employs a heat generating system based on electromagnetic induction. This type of heating apparatus is employed, as a fixing apparatus, in an image forming apparatus, for example, a copying machine, a printer, a facsimile machine, or the like.

Usually, an image forming apparatus such as a copying machine, a printer, or a facsimile machine, is equipped with a heating apparatus.

A heating apparatus is used as a fixing apparatus, or a surface treating apparatus. In the case of the latter usage, it is used to heat a sheet of recording medium comprising a surface layer of porous high polymer, to melt the porous high polymer surface layer after an image is formed on the sheet with the usage of, for example, an ink jet system.

Next, a case in which a heating apparatus is employed as a fixing apparatus will be described.

An electrophotographic copying machine or the like is equipped with a fixing apparatus which fixes a toner image to a sheet of recording medium, for example, recording paper, after the toner image is transferred onto the sheet.

Such a fixing apparatus comprises a fixing roller for thermally melting the toner on a sheet of recording medium, and a pressure roller for holding the sheet against the fixing roller with a predetermined pressure. The fixing roller is sometimes called a heating roller.

The fixing roller comprises a hollow cylinder, and a heating member disposed in the cylinder. They are concentrically supported with the central axis of the fixing roller.

The heating member consists of a tubular heater such as a halogen lamp or the like, and generates heat as a predetermined voltage is applied to the heating member.

Since the heating member, or a halogen lamp, is concentrically supported, along with the cylinder of the heating roller, by the central axis of the heating roller, the radiant heat from the halogen lamp is uniformly distributed across the internal surface of the cylinder of the fixing roller. As a result, the temperature distribution of the cylinder of the fixing roller becomes uniform in terms of the circumferential direction of the cylinder.

The cylinder of the fixing roller is heated until its temperature reaches a specific temperature suitable for image fixation (for example, 150°–120°).

The fixing roller, the temperature of which is within the above range, and the pressure roller are rotated in the directions opposite to each other while being in contact with each other, and hold between them a sheet of recording medium on which a toner image has been temporarily adhered.

The toner on the sheet is melted by the heat from the fixing roller, and is fixed to the sheet by the pressure generated by the two rollers, in their interface (hereinafter, "nip").

However, in the case of a fixing apparatus such as the above described one equipped with a heating member consisting of a halogen lamp or the like, the fixing roller is heated with the use of radiant heat from a halogen lamp or the like, and therefore, the time necessary for the temperature of the fixing roller to reach the predetermined temperature suitable for image fixation after a power source is turned on (hereinafter, "warmup time"), is relatively long.

In other words, a user has to wait for a relatively long time without being able to use the copying machine during this warmup period, which is a problem.

There is a method for reducing the length of the warmup time so that the operational efficiency of the apparatus is improved, according to which a large amount of electric power is given to the fixing roller. However, this method increases the electrical power consumption of the fixing apparatus, which is a problem in terms of energy conservation.

Thus, recently, more attention has been paid to reducing the amount of energy consumed by a fixing apparatus while improving operational efficiency (quick print capability), so that the commercial value of such merchandise as a copying machine can be further improved.

As for an apparatus which meets such a requirement, there is an induction heating based fixing apparatus disclosed in Japanese Laid-Open Patent Application No. 33,787/1984, according to which a high frequency induction system is used as a heating generating source.

The aforementioned induction heating based fixing apparatus comprises a hollow roller formed of electrically conductive metal, and a coil disposed in the hollow roller, concentrically with the hollow roller. In operation, eddy current is induced in the hollow roller by a high frequency magnetic field generated by flowing high frequency electric current through the coil, and heat (joule heat) is directly generated within the hollow roller by the induced current and the electrical resistance of the hollow roller.

The inductive heat generation system is very high in electrothermal conversion efficiency, and therefore, its employment makes it possible to substantially reduce the warmup time of a fixing apparatus.

Further, combining the coil with a core formed of magnetic material (magnetic field shielding material) can improve the efficiency with which high frequency magnetic field is generated.

In particular, the employment of a core with a T-shaped cross section reduces the amount of electric power necessary to generate a given amount of heat required by a fixing apparatus, because the core with a T-shaped cross section is effective in focusing high frequency magnetic fluxes, and also shielding the magnetic field so that the magnetic field is confined in the heat generating area.

However, the aforementioned conventional technology had the following problems.

That is, in the case of an inductive heat generation based fixing apparatus such as the one described above, the temperature of the magnetic core itself increased due to the inward heat radiation from the fixing roller, which was one of the problems.

More specifically, as the temperature of the magnetic core increased beyond the Curie-point of the magnetic material of the core, the heat generation efficiency decreased, which resulted in fixation failure, which in turn resulted in the production of inferior images.

Thus, various proposals for preventing the temperature increase of the magnetic core were made. According to one of the proposals, disclosed in Japanese Laid-Open Patent Application No. 39/645/1979, a cooling mechanism such as a means for sending air into the interior of the fixing roller was provided to reduce the amount of the coil temperature increase.

However, the provision of a cooling mechanism resulted in the increase in the apparatus size, as well as the complication of the apparatus.

The inventors of the present invention proposed a simple structure which was capable of preventing the temperature increase of the magnetic core without increasing the apparatus size. According to this proposal, the supporting member for fixing the core and the coil to the side plate or the like of a fixing apparatus was formed of highly heat conductive material such as aluminum, so that heat was conducted out of the fixing roller through the supporting member.

However, such a structure was only theoretically successful in allowing heat to escape outward through the highly heat conductive material such as aluminum so that the core remained cool. More specifically, the surface of the core formed of magnetic material with the use of extruding, grinding, or the like production method did not fit tightly with the supporting member (hereinafter, "stay") due to design error or the like. Therefore, heat was not allowed to efficiently escape from the core to the stay.

SUMMARY OF THE INVENTION

The primary object of the present invention is to prevent the temperature increase of the magnetic member, so that it becomes possible to provide an image heating apparatus capable of reliably heating an image.

Another object of the present invention is to provide an image forming apparatus equipped with a heat conductive member for filling the gap between the magnetic member and the heat conductive member (stay).

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. The measurements, materials, shapes, positional relationships, and the like, of the structural components described in the following embodiments do not need to be limited to those described in this specification unless specifically noted.

The heating apparatuses in the following embodiments are those compatible with image forming apparatuses such as a copying machine. The structure and operation of an image forming apparatus are well known, and therefore, their detailed descriptions will be omitted here.

In the following embodiments of the present invention, cases in which a heating apparatus is employed as the fixing apparatus of an electrophotographic image forming apparatus will be described.

Briefly, describing the structure of an electrophotographic image forming apparatus, the image forming apparatus is provided with a fixing apparatus so that after a toner image is formed on a sheet of recording medium through a known electrophotographic process, the toner image (unfixed image) on the sheet can be fixed to the sheet with the application of heat and pressure.

First, referring to FIGS. 1 and 2, the image heating apparatus (fixing apparatus) in the first embodiment of the present invention will be described.

Figure 1:
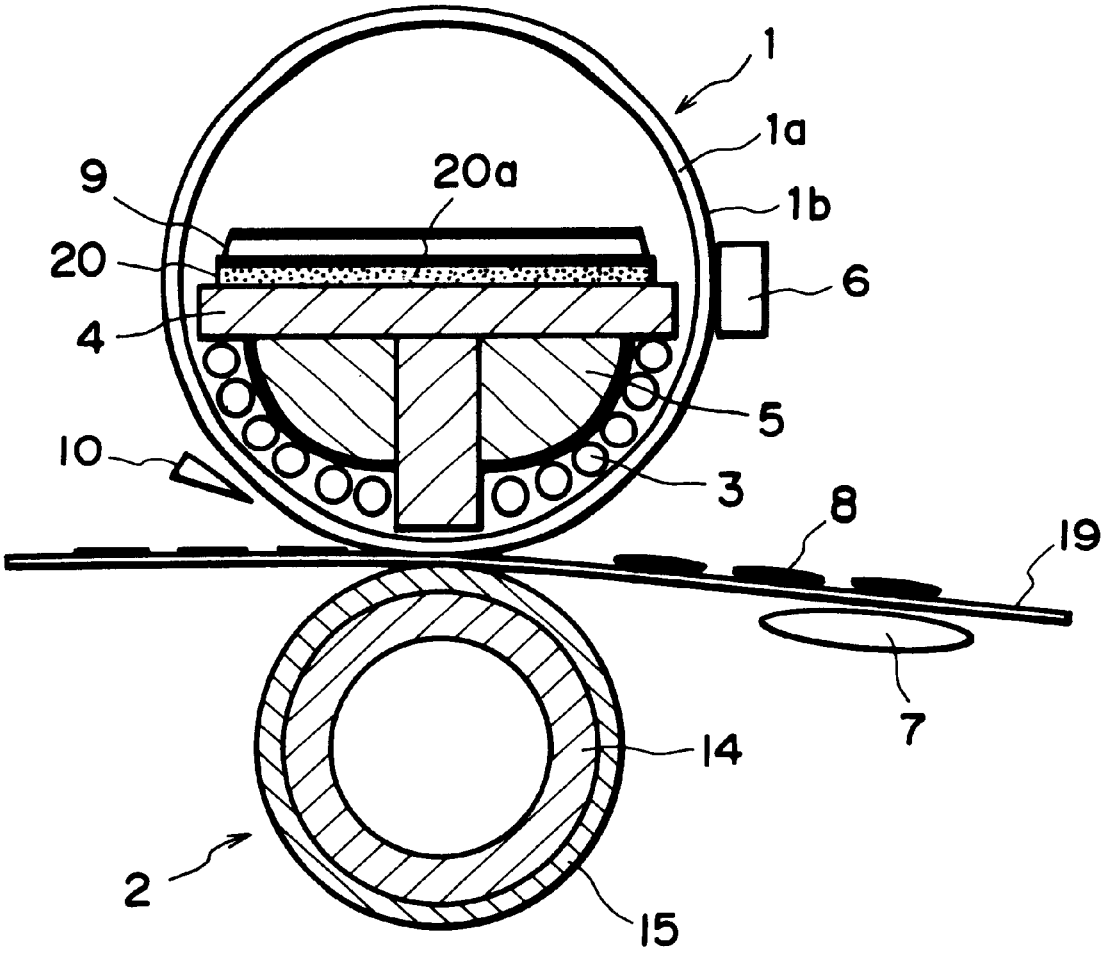
FIG. 1 is a schematic sectional view of the fixing apparatus in the first embodiment of the present invention, and depicts the general structure of the apparatus.

FIG. 1 is a schematic sectional view of the fixing apparatus in the first embodiment of the present invention, and depicts the general structure of the apparatus.

A fixing roller 1, which is an electrically conductive member, comprises a steel cylinder 1*a* and a surface layer 1*b*. The steel cylinder 1*a* has an external diameter of, for example, 40 mm, and a thickness of, for example, 0.7 mm. The surface layer 1*b* is, for example, a 10–50 $\mu$m thick PTFE layer or a 10–50 $\mu$m thick PFA layer.

A pressure roller 2, which is a backup member, comprises a hollow metallic cylinder 14, and an elastic layer 15, that is, a layer of heat resistant, separation enhancing rubber, formed on the peripheral surface of the cylinder 14.

The pressure roller 2 is rotatively supported at each longitudinal end by one of the bearing portions of the frame of an unillustrated fixing unit.

Although the fixing roller 1 and the pressure roller 2 are both rotatively supported, only the fixing roller 1 is driven.

The pressure roller 2 is placed in contact with the peripheral surface of the fixing roller, with the application of a predetermined amount of contact pressure, so that is rotates due to the friction between the two rollers in the nip.

The pressure roller 2 is kept under the pressure generated toward the rotational axis of the fixing roller 1 by an unillustrated mechanism, which comprises a spring or the like.

The amount of the pressure applied to the pressure roller 2 is approximately 30 kg so that a nip with a width of approximately 6 mm, in terms of the circumferential direction of the pressure roller 2, is formed between the pressure roller 2 and the fixing roller 1.

The nip width may be varied by varying the amount of the pressure applied to the pressure roller 2, in consideration of the condition under which the apparatus is operated.

The temperature of the peripheral surface of the fixing roller 1 is automatically controlled so that it remains at a predetermined point. More specifically, a temperature sensor 6 is placed in contact with, or immediately adjacent to, the peripheral surface of the fixing roller 1, and the amount of the electric power to be supplied to an exciter coil 3 as an exciting means is increased or decreased in response to the signals which reflect the temperatures detected by the temperature sensor 6.

A conveyer guide 7 is disposed so that a recording medium 19 on which an unfixed toner image 8 is borne is guided into the interface (nip) between the fixing roller 1 and the pressure roller 2.

A separating claw 10 is disposed in contact with, or immediately next to, the peripheral surface of the fixing roller 1 to prevent the recording medium 19 from being wrapped around the fixing roller 1.

An exciter coil 3 is wound around a magnetic core 4 with a T-shaped cross section (hereinafter, "core 4"). More specifically, it is wound around a holder 5 disposed in a manner to surround the central projection of the magnetic core 4 so that the straight portions of the coil 3 extend in the longitudinal direction of the fixing roller in parallel to the internal surface of the cylinder 1*a*. The holder 5 is formed of heat resistance material such as PPS, PEEK, phenol resin, or the like.

In order to generate magnetic fluxes, an AC current with a frequency of 10–100 kHz is flowed through the exciter coil 3.

The magnetic field (in other words, magnetic fluxes) induced by the AC current is guided by the core 4, as a magnetic field guiding means, with a high degree of magnetic permeability, and generates magnetic fluxes and eddy current within the fixing roller 1 as a heating means. This eddy current generates Joule heat due to the specific resistivity of the cylinder 1*a* of the fixing roller 1.

In order to increase the amount of the Joule heat, it is possible to increase the number of times the exciter coil is wound, to use such material as ferrite or Permalloy, which is high in magnetic permeability and low in residual magnetic flux density, as the material for the core 4, and/or to increase the frequency of the AC current.

The core 4 is structured so that its cross section becomes T-shaped, and extends in the direction of the rotational axis of the fixing roller 1, in order to shield the magnetic field generated by the excitation of the exciter coil 3 so that the magnetic field is concentrated toward the heating portion.

The T-shaped core 4 is adhered to an aluminum stay 9, as a supporting member, which has a width of 32 mm and a thickness of 3 mm, with the use of highly heat conductive adhesive 20.

The highly heat conductive adhesive 20 is, for example, a compound composed of, for example, epoxy resin, which is heat resistance resin, and boron nitride mixed as filler 20*a* in the epoxy resin to provide the adhesive 20 with heat conductivity (heat conductivity of highly heat conductive adhesive 20 is 3 W/mK). Boron nitride is nonmagnetic, and is in the form of a particle, in this embodiment.

The stay 9 is a heat conductive member for dissipating the heat of the core 4. The material for the stay 9 has only to be capable of effectively conducting the internal heat of the core 4. In essence, it may be any material as long as it is superior in heat conductivity; for example, copper as well as aluminum. The heat conductive adhesive 20 fills the gap between the core 4 and the stay 9.

The radiant heat from the fixing roller 1 increases the temperature of the core 4, but this heat is conducted from the core 4 to the stay 9 through the highly heat conductive adhesive 20. The stay 9 extends in the axial direction of the fixing roller 4 as does the core 4.

Then, the heat is further conducted to an unillustrated side plate of the fixing apparatus; the heat is dissipated out of the magnetic core 4.

In order for the above described structure to keep the surface temperature of the fixing roller 1 at 190° C., that is, the most appropriate temperature for image fixation, approximately 200 W of electric power must be supplied to the exciter coil 3.

As 200 W of electric power is supplied to the exciter coil 3, the temperature of the exciter coil 3 reaches approximately 210° C., and the temperature of the magnetic core 4 reaches approximately 200° C.

Further, in order to continuously fix a large number of toner images at a high rate, for example, a rate of 30 toner images (sheets) per minute, it is necessary to supply the exciter coil 3 with approximately 450 W of electric power. Under this condition, the temperature of the exciter coil 3 reaches as high as approximately 230° C., and the temperature of the magnetic core 4 reaches as high as approximately 220° C.

Therefore, the Curie point of the magnetic core 4 must be no less than 220° C. in consideration of the aforementioned situation in which a large number of toner images (sheets) are continuously fixed.

As the temperature of the magnetic core 4 exceeds its Curie point (point beyond which the magnetism of the magnetic core 4 is drastically weak), the electrothermal conversion efficiency of the heating roller 1 suddenly drops.

Figure 2:
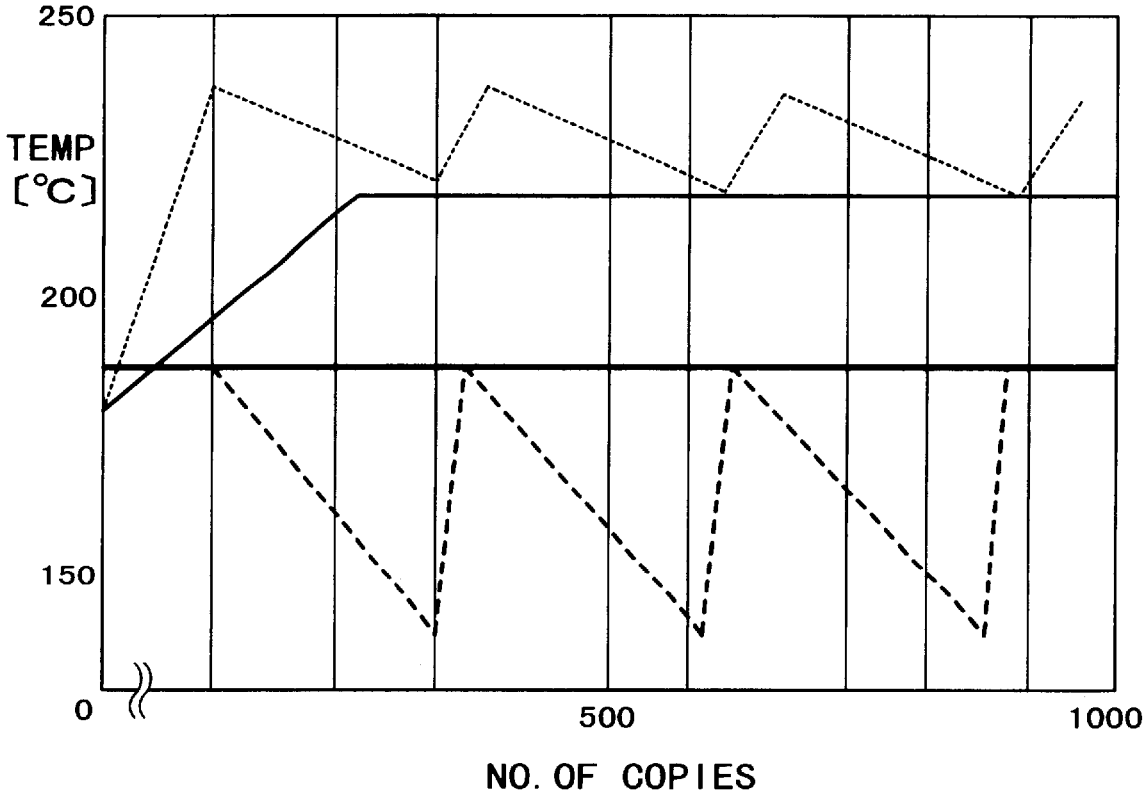
FIG. 2 is a graph which shows the temperature fluctuation of the fixing roller and the magnetic core which is affected by the presence or absence of the highly heat conductive adhesive.

FIG. 2 is a graph which comparatively shows the fluctuation in the surface temperature of the fixing roller 1, and the fluctuation of the temperature of the magnetic core 4, which occurred when unfixed toner images (sheets) were continuously fixed at 190° C. while applying a high frequency AC power with a voltage level of 100 V and a frequency of 20 kHz to the exciter coil 3 after initially supplying the exciter coil 3 with 1,300 W; (a) and (b) represent the tests in which the gap between the stay 9 and the magnetic core 4 was filled, and not filled, with the adhesive 20, respectively.

It is evident from FIG. 2 that in the case of the test (b), the surface temperature of the fixing roller 1 dropped after the passage of 200 sheets.

This drop occurred because the temperature of the magnetic core 4 disposed within the fixing roller 2 reached 240° C., that is, the Curie point of the magnetic core 4, beyond which the electrothermal conversion efficiency of the fixing roller 1 dropped.

After dropping for a while, the surface temperature of the fixing roller 1 began increasing again.

On the contrary, in the case of the test (a), in which the highly heat conductive adhesive 20 was present between the magnetic core 4 and the stay 9, the temperature drop did not occur; the surface temperature of the fixing roller 1 remained stable.

The temperature drop did not occur because the heat was efficiently conducted out of the magnetic core 4, and therefore, the temperature of the magnetic core 4 was prevented from rising.

In the first embodiment of the present invention described above, the image fixing member consisted of a heating roller. However, the present invention is also applicable to a fixing apparatus in which a sheet of thin metallic film is employed in place of a heating roller.

As is evident from the above description of the present invention, filling the gap between the magnetic core and the stay by interposing heat conductive adhesive between the magnetic core and the stay can prevent the temperature increase of the magnetic core, which in turn can keep the heating efficiency of the fixing roller. As a result, the fixing performance of a fixing apparatus remains stable.

Boron nitride dispersed as filler in the heat conductive adhesive in this embodiment is nonmagnetic. Therefore, the magnetic fluxes are not absorbed by the adhesive. In other words, the temperature of the adhesive 20 is not increased by the magnetic field; the presence of the adhesive layer 20 simply improves the heat generation efficiency of the fixing roller 1.

Figure 3:
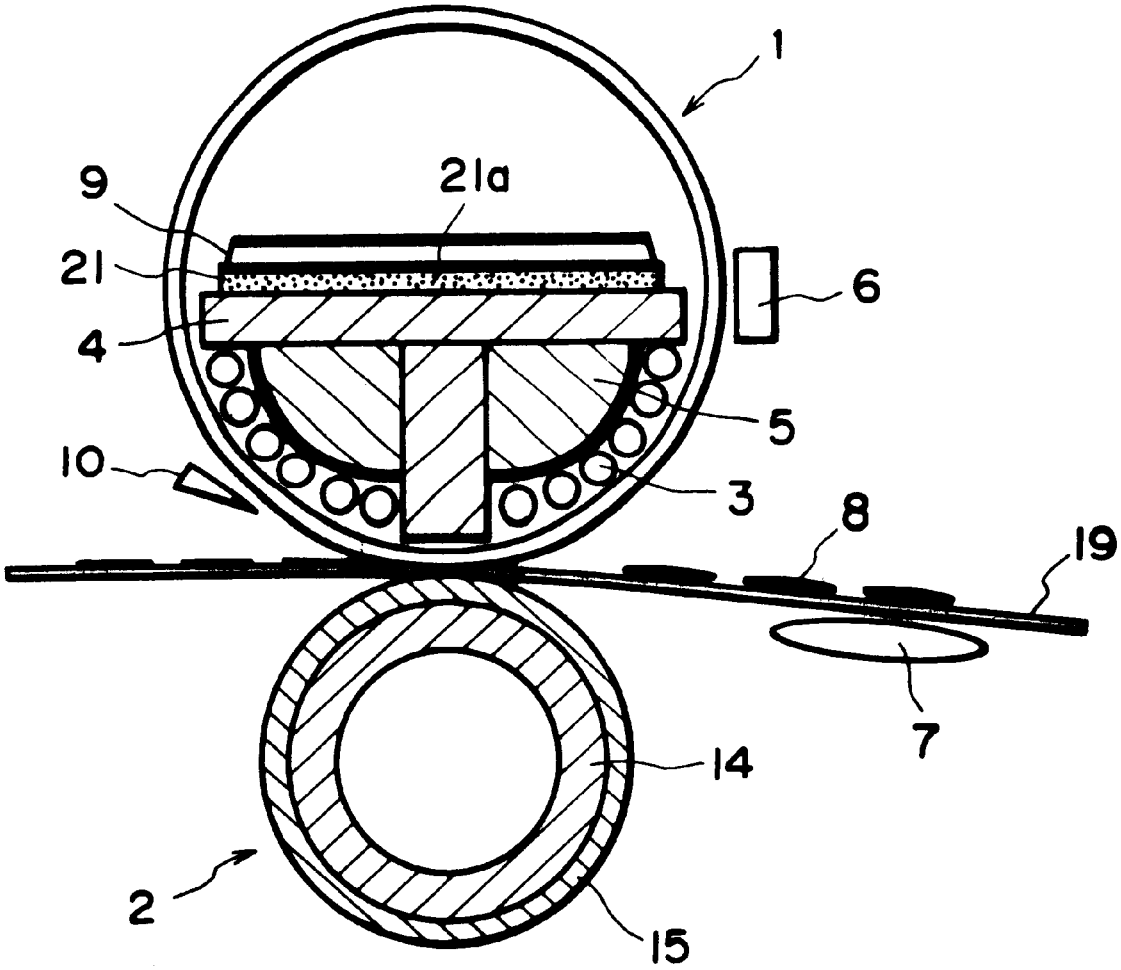
FIG. 3 is a schematic sectional view of the fixing apparatus in the second embodiment of the present invention, and depicts the general structure of the apparatus.

FIG. 3 depicts the second embodiment of the present invention. In this embodiment, a piece of heat conductive double-sided adhesive tape is used as heat conductive material, unlike the first embodiment in which heat conductive adhesive was used as heat conductive material.

Since the structure and operation of the fixing apparatus in this embodiment are the same as those in the first embodiment, the same structural components as those in the first embodiment are given the same referential characters as those in the first embodiment, and their descriptions will be omitted.

FIG. 3 is a schematic sectional view of the fixing apparatus in the second embodiment of the present invention, and depicts the general structure of the apparatus.

As shown in the drawing, in this embodiment, a piece of highly heat conductive adhesive tape 21 is placed between the magnetic core 4 and the stay 9.

Also in this double-sided tape 21, highly heat conductive and nonmagnetic filler 21*a* is contained.

The gap between the magnetic core 4 and the stay 9 can also be relatively easily filled by this configuration to prevent the temperature increase of the magnetic core 4.

Figure 4:
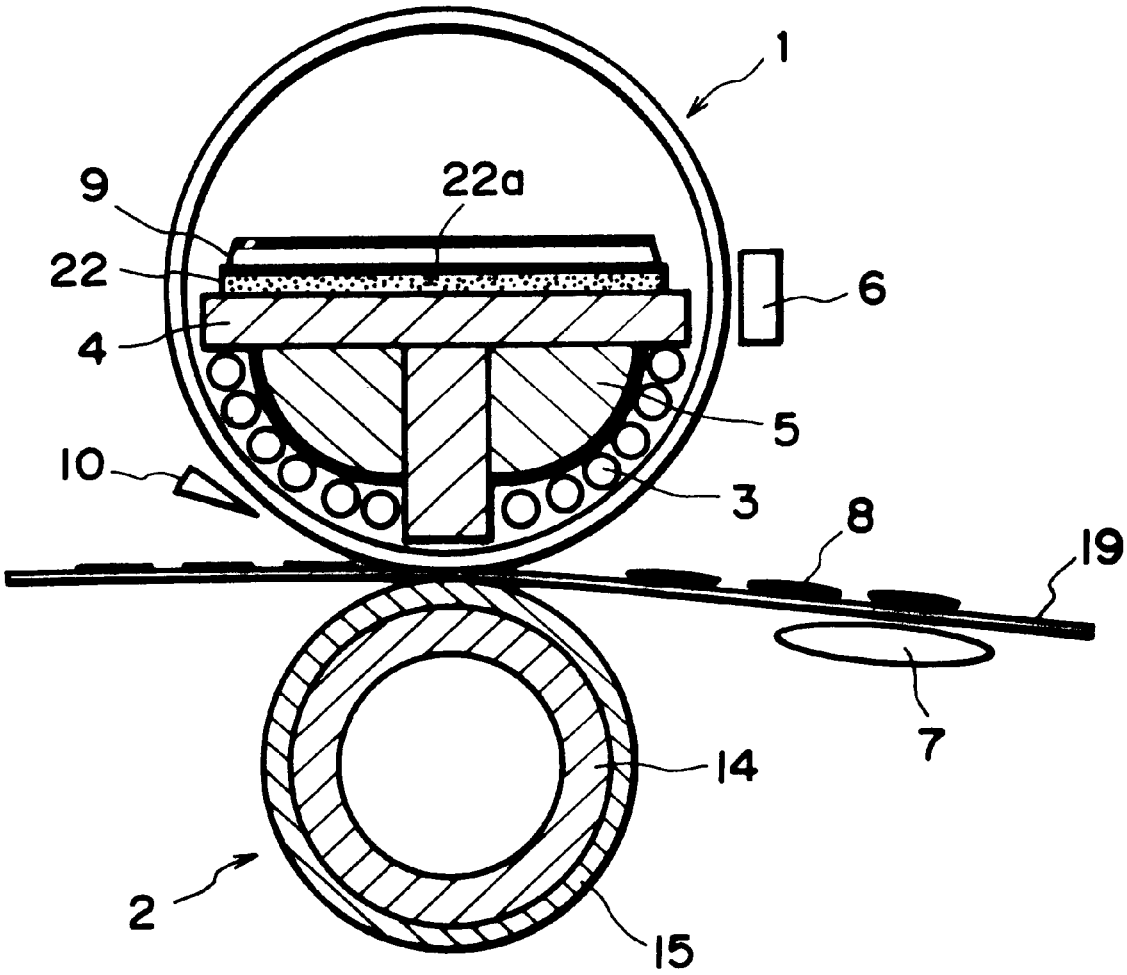
FIG. 4 is a schematic sectional view of the fixing apparatus in the third embodiment of the present invention, and depicts the general structure of the apparatus.

FIG. 4 depicts the third embodiment of the present invention. In this embodiment, highly heat conductive grease is used as heat conductive material, unlike in the first embodiment in which heat conductive adhesive was used as heat conductive material.

Since the structure and operation of the fixing apparatus in this embodiment are the same as those in the first embodiment, the same structural components as those in the first embodiment will be given the same referential characters, and their descriptions will be omitted.

FIG. 4 is a schematic sectional view of the fixing apparatus in the third embodiment of the present invention, and depicts the general structure of the apparatus.

As the drawing shows, a certain amount of highly heat conductive silicon grease 22 is interposed between the magnetic core 4 and the stay 9.

The grease used in this embodiment is composed of highly heat resistant silicon grease, and particles of aluminum nitride. The particles of aluminum nitride, which is highly heat conductive, and nonmagnetic, are added, as filler particles 22*a,* to the silicon grease by 5%.

With this arrangement, the gap between the magnetic core 4 and the stay 9 can be satisfactorily filled regardless of the method for fixing the magnetic core 4 to the stay 9, to prevent the temperature increase of the magnetic core 4.

The heat conductivities of the heat conductive materials described up to this point are desired to be no less than 1 W—$m^{-1}k^{-1}$ and no more than 500 $W \cdot m^{-1}k^{-1}$.

As for the material for the particles to be dispersed as filler in the heat conductive material, the particles of aluminum (Al), alumina ($Al_2O_3$), silica, carbon, etc., which are highly heat conductive and nonmagnetic, can be listed in addition to those mentioned above.

Further, the above described heating apparatuses as a fixing apparatus can be utilized as a surface treating apparatus for giving a surface treatment to a sheet of recording medium with a porous high polymer surface layer.

To describe such a case briefly, an image forming apparatus is provided with a surface treating apparatus, so that a sheet of recording medium with a porous high polymer layer, on which an image is formed with the use of the so-called ink jet system, is heated to melt the porous high polymer layer.

Also in the case of such an apparatus, the employment of the structure in accordance with the present invention assures that the surface of the recording medium is satisfactorily treated with a stable amount of heat.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

an electro-conductive member;

an excitation coil for generating magnetic flux;

wherein eddy current is produced in said electro-conductive member by the magnetic flux, so that said electro-conductive member generates heat which heats an image on a recording material;

a magnetic member for guiding the magnetic flux generated by said excitation coil:

a heat removing member for removing heat from said magnetic member; and a thermo-conductive member disposed in a gap between said magnetic member and said heat removing member;

wherein said thermo-conductive member comprises non-magnetic thermo-conductive filler.

2. An apparatus according to claim 1, wherein said thermo-conductive member is a bonding material.

3. An apparatus according to claim 1, wherein said thermo-conductive member is a double sided adhesive tape.

4. An apparatus according to claim 1, wherein said thermo-conductive member is grease.

5. An apparatus according to claim 1, wherein said thermo-conductive member has a thermal conductivity of 1–500 W/mk.

6. An apparatus according to claim 1, wherein said electro-conductive member is in the form of a roller.

7. An apparatus according to claim 6, wherein said excitation coil, said magnetic member and said heat removing member are disposed in said roller.

8. An apparatus according to claim 6, wherein said magnetic member and said heat removing member are elongated in an axial direction of said roller.

9. An apparatus according to claim 1, further comprising a back-up member for forming a nip with said electro-conductive member, wherein the nip feeds the recording material carrying an unfixed image so that the unfixed image on the recording material is fixed thereon.

* * * * *

UNITED STATES PATENT AND TRADEMARK OFFICE

CERTIFICATE OF CORRECTION

PATENT NO. : 6,198,901 B1
DATED : March 6, 2001
INVENTOR(S) : Osamu Watanabe

It is certified that error appears in the above-identified patent and that said Letters Patent is hereby corrected as shown below:

Sheet No. 2,
Figuare 2, "THERMOCONDUCTIV ADHESIVE" (both Occurrences) should read -- THERMOCONDUCTIVE ADHESIVE --.

Column 2,
Line 64, "39/645/1979," should read -- 39,645/1979, --.

Column 4,
Line 36, "is" should read -- it --.
Line 60, "borne" should read -- born --.

Column 7,
-Line 52, "W_$m^{-1}k^{-1}$" should read -- W· $m^{-1}k^{-1}$ --.

Column 8,
Line 22, "flux;" should read -- flux, --.
Line 28, "coil:" should read -- coil; --.
Line 33, "ber;" should read -- ber, --.

Signed and Sealed this

Thirtieth Day of October, 2001

*Attest:*

Nicholas P. Godici

*Attesting Officer*

NICHOLAS P. GODICI
*Acting Director of the United States Patent and Trademark Office*